US009990889B2

(12) United States Patent
Song et al.

(10) Patent No.: US 9,990,889 B2
(45) Date of Patent: Jun. 5, 2018

(54) ORGANIC LIGHT-EMITTING DISPLAY DEVICE AND DRIVING METHOD THEREOF

(71) Applicant: SAMSUNG DISPLAY CO., LTD., Yongin, Gyeonggi-Do (KR)

(72) Inventors: Jun Yong Song, Hwaseong-si (KR); Kyung Youl Min, Hwaseong-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 532 days.

(21) Appl. No.: 14/610,214

(22) Filed: Jan. 30, 2015

(65) Prior Publication Data

US 2016/0055800 A1 Feb. 25, 2016

(30) Foreign Application Priority Data

Aug. 25, 2014 (KR) ..... 10-2014-0110971

(51) Int. Cl.
*G09G 3/32* (2016.01)
*G09G 3/3291* (2016.01)

(52) U.S. Cl.
CPC ... *G09G 3/3291* (2013.01); *G09G 2300/0426* (2013.01); *G09G 2300/0452* (2013.01); *G09G 2310/0297* (2013.01); *G09G 2320/0673* (2013.01)

(58) Field of Classification Search
CPC ... G09G 2300/0426; G09G 2310/0297; G09G 2320/0673; G09G 3/32
See application file for complete search history.

(56) References Cited

U.S. PATENT DOCUMENTS

2004/0246404 A1* 12/2004 Elliott ..... G02F 1/1368 349/88
2005/0243044 A1* 11/2005 Kang ..... G02F 1/136286 345/87
2006/0081850 A1 4/2006 Lee et al.
2008/0180463 A1* 7/2008 Ogura ..... G09G 3/325 345/690
2009/0021534 A1* 1/2009 Tomizawa ..... G09G 3/2003 345/690
2010/0265238 A1 10/2010 Lee et al.
(Continued)

FOREIGN PATENT DOCUMENTS

KR 10-2004-0107672 A 12/2004
KR 10-2014-0044568 A 4/2014

*Primary Examiner* — William Boddie
*Assistant Examiner* — Andrew Schnirel
(74) *Attorney, Agent, or Firm* — Lee & Morse, P.C.

(57) ABSTRACT

A display device has first and second pixel columns and at least one third pixel column. The first pixel column includes first pixels to emit light of a first color and a second pixels to emit light of a second color alternately arranged in a first direction. The second pixel column includes the first pixels and the second pixels arranged in the first direction in a reverse order from the first pixel column. The at least one third pixel column includes third pixels to emit light of a third color and arranged in the first direction. The first and second pixel columns are alternately arranged in a second direction crossing the first direction. The third pixel column is between the first and second pixel columns. The second pixel of the first pixel column and the second pixel of the second pixel column are connected to a same data line.

17 Claims, 6 Drawing Sheets

(56) References Cited

U.S. PATENT DOCUMENTS

| | | | | |
|---|---|---|---|---|
| 2010/0302215 | A1* | 12/2010 | Tsai | G09G 3/3614 345/204 |
| 2011/0025669 | A1* | 2/2011 | Kwak | G09G 3/3225 345/211 |
| 2011/0187682 | A1* | 8/2011 | Kim | G09G 5/00 345/204 |
| 2014/0125647 | A1* | 5/2014 | Shin | G09G 3/3648 345/212 |
| 2014/0160172 | A1* | 6/2014 | Lee | G09G 3/3607 345/690 |
| 2014/0209932 | A1* | 7/2014 | Huang | H01L 27/124 257/88 |

* cited by examiner

ORGANIC LIGHT-EMITTING DISPLAY DEVICE AND DRIVING METHOD THEREOF

CROSS-REFERENCE TO RELATED APPLICATION

Korean Patent Application No. 10-2014-0110971, filed on Aug. 25, 2014, and entitled, "Organic Light-Emitting Display Device and Driving Method Thereof," is incorporated by reference herein in its entirety.

BACKGROUND

1. Field

One or more embodiments described herein relate to an organic light-emitting display device and a method for driving such a device.

2. Description of the Related Art

A variety of flat panel displays have been developed. Examples include liquid crystal displays, organic light-emitting displays, and electrophoretic displays. These displays are in wide use because they are thin and lightweight. These displays are also versatile, finding use in many domestic products such as televisions and monitors, as well as in portable devices including but not limited to notebook computers, mobile phones, and portable multimedia players (PMPs).

Organic light-emitting displays consume less power, realize higher luminance, and higher contrast ratios than other types of flat panel displays. Due to these and other benefits, the demand for organic light-emitting display devices has continued to grow.

A flat panel display may generally include data lines for applying data signals and emission information for each pixel, and scan lines for applying a scan signal to allow the data signals to be sequentially applied to the pixels. In one type of display, the number of pixels connected to a same data line are connected to different scan lines, and the number of pixels connected to the same scan line are connected to different data lines.

In order to increase the number of pixels to improve the display resolution, the number of data lines, scan lines, and circuits in a data driving unit may be increased. This may result in an increase in manufacturing costs and power consumption.

SUMMARY

In accordance with one embodiment, an organic light-emitting display device including a display panel having a plurality of pixels arranged in a matrix, the plurality of pixels including: a first pixel column including first pixels to emit light of a first color and a second pixels to emit light of a second color alternately arranged in a first direction, a second pixel column including the first pixels and the second pixels arranged in the first direction in a reverse order from the first pixel column, and at least one third pixel column including third pixels to emit light of a third color and arranged in the first direction, wherein the first pixel column and the second pixel column are alternately arranged along a second direction crossing the first direction, wherein the third pixel column is between the first pixel column and the second pixel column, and wherein the second pixel of the first pixel column and the second pixel of the second pixel column are connected to a same data line.

One of the first pixels of the first pixel column, one of the first pixels of the second pixel column, and one of the third pixels of the third pixel column, which is arranged next to the first pixel column in the second direction, may be connected to a first data line, and the second pixel of the first pixel column, the second pixel of the second pixel column, and a third pixel of another third pixel column, which is arranged next to the second pixel column in the second direction, may be connected to a second data line.

The device may include a data voltage output to apply a first pixel data voltage or a third pixel data voltage to the first data line and to apply a second pixel data voltage or the third pixel data voltage to the second data line. The data voltage output may include a gamma voltage output to generate the first, second, and third pixel data voltages, a switching circuit to selectively output the first, second, and third pixel data voltages, and a buffer to amplify the first, second, and third pixel data voltages. The data voltage output may be in the display panel.

The display panel may include a plurality of scan lines extending in the second direction, the first pixel of the first pixel column and the third pixel of the third pixel column, which is arranged next to the first pixel column in the second direction, may be connected to different scan lines, and the second pixel of the second pixel column and the third pixel of the other third pixel column, which is arranged next to the second pixel column in the second direction, may be connected to different scan lines.

The display panel may include a plurality of scan lines extending in the second direction, the first pixel of the first pixel column and the third pixel of the third pixel column, which is arranged next to the first pixel column in the second direction, may be connected to the same scan line, and the second pixel of the second pixel column and the third pixel of the other third pixel column, which is arranged next to the second pixel column in the second direction, may be connected to the same scan line.

The display panel may include a plurality of scan lines extending in the second direction, and a plurality of scan signals may be applied to the plurality of scan lines, respectively, in such a manner that the second pixel of the second pixel column and then the second pixel of the first pixel column are turned on. The plurality of scan signals may be applied to the plurality of scan lines, respectively, in such a manner that the second pixel of the first pixel column and then the third pixel of the third pixel column, which is arranged next to the first pixel column in the second direction, may be turned on. The first, second, and third colors may be red, blue and green, respectively.

In accordance with another embodiment, an organic light-emitting display device includes a plurality of data lines extending in a second direction; a plurality of scan lines extending in the second direction crossing a first direction; and a plurality of pixels including: a first pixel column including first pixels to emit light of a first color and second pixels to emit light of a second color alternately arranged in the first direction, a second pixel column including the first pixels and the second pixels arranged in the first direction in a reverse order from the first pixel column, and at least one third pixel column including third pixels to emit light of a third color and arranged in the first direction, wherein the plurality of pixels forms a Pen Tile structure in which the first pixel column and the third pixel column are arranged next to each other, and the second pixel column and another third pixel column are arranged next to each other, and wherein the second pixel of the first pixel column and the second pixel of the second pixel column are connected to a same data line.

The first pixel of the first pixel column, the first pixel of the second pixel column, and a third pixel of the third pixel column, which is arranged next to the first pixel column in the second direction, may be connected to a first data line, and the second pixel of the first pixel column, the second pixel of the second pixel column, and a third pixel of another third pixel column, which is arranged next to the second pixel column in the second direction, may be connected to a second data line.

The device may include a data voltage output to apply a first pixel data voltage or a third pixel data voltage to the first data line and to apply a second pixel data voltage or the third pixel data voltage to the second data line.

The data voltage output may include a gamma voltage output to generate the first, second, and third pixel data voltages, a switching circuit to selectively output the first, second, and third pixel data voltages, and a buffer to amplify the first, second, and third pixel data voltages. The first pixel column, the third pixel column, the second pixel column, and another third pixel column may be sequentially arranged side-by-side in the second direction. The third pixel column, the first pixel column, another third pixel column, and the second pixel column may be sequentially arranged side-by-side in the second direction.

In accordance with another embodiment, a method for driving an organic light-emitting display device includes providing an organic light-emitting display device which includes a display panel having a plurality of pixels arranged in a matrix, the plurality of pixels including: (a) a first pixel column including first pixels to emit light of a first color and second pixels to emit light of second color alternately arranged in a first direction, (b) a second pixel column including the first pixels and the second pixels arranged in the first direction in a reverse order from the first pixel column, and (c) at least one third pixel column including third pixels to emit light of a third color and arranged in the first direction, the first pixel column and the second pixel column alternately arranged along a second direction crossing the first direction, the third pixel column between the first pixel column and the second pixel column, and the second pixel of the first pixel column and the second pixel of the second pixel column connected to a same data line; applying a first pixel data voltage to the first pixel of each of the first and second pixel columns; and applying a third pixel data voltage or a second pixel data voltage to the data line to which the second pixel of the first pixel column and the second pixel of the second pixel column are connected.

Applying may include applying the third pixel data voltage to a third pixel of the third pixel column based on a first scan signal, applying the second pixel data voltage to the second pixel of the second pixel column based on a second scan signal, which is followed by the first scan signal, and applying the second pixel data voltage to the second pixel of the first pixel column based on a third scan signal, which is followed by the second scan signal.

Applying may include applying the second pixel data voltage to the second pixel of the first pixel column based on a first scan signal, applying the second pixel data voltage to the second pixel of the second pixel column based on a second scan signal, which is followed by the first scan signal, and applying the third pixel data voltage to a third pixel of the third pixel column, which is arranged next to the first pixel column in the second direction, based on a third scan signal, which is followed by the second scan signal. The first, second, and third colors may be red, blue and green, respectively.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
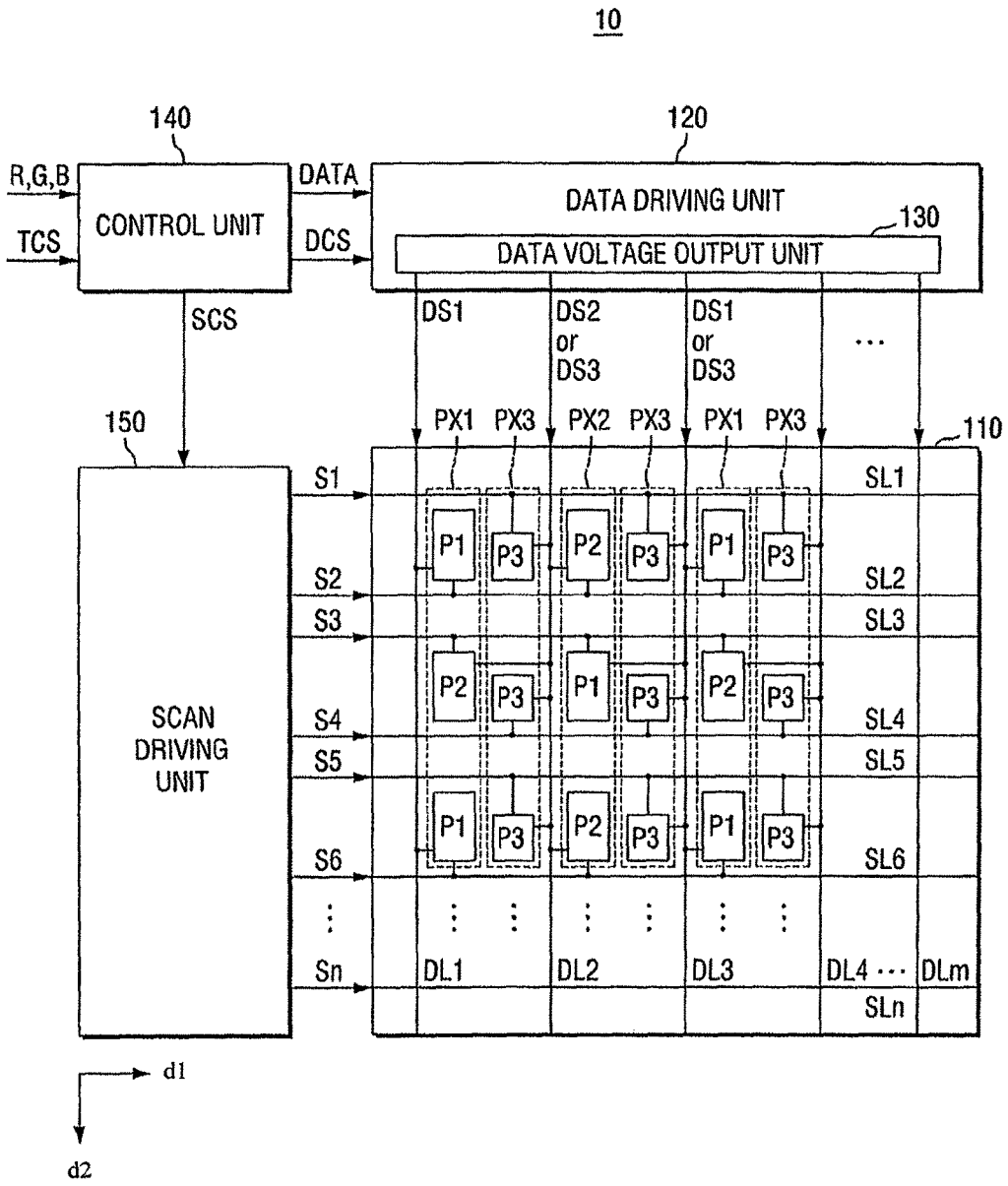
FIG. 1 illustrates an embodiment of an organic light-emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

FIG. 1 illustrates an embodiment of an organic light-emitting display device 10 which includes a display panel 110, a data driving unit 120, a data voltage output unit 130, a control unit 140, and a scan driving unit 150.

The display panel 110 displays an image and may be, for example, a liquid crystal display panel, an electrophoretic display panel, an organic light-emitting diode display panel, a light-emitting diode display panel, an inorganic electroluminescent display panel, a field emission display panel, a surface-conduction electron-emitter display panel, a plasma display panel, or a cathode ray tube (CRT) display panel. In the description that follows, it is assumed that the display panel 110 is an OLED display panel.

The display panel 110 includes a plurality of scan lines SL1, SL2, . . . , SLn, a plurality of data lines DL1, DL2, . . . , DLm intersecting the scan lines SL1, SL2, . . . , SLn, and a plurality of pixels PX connected to the scan lines SL1, SL2, . . . , SLn and to the data lines DL1, DL2, . . . , DLm. The scan lines SL1, SL2, . . . , SLn may extend in a second direction d1, and may be substantially parallel with one another. The scan lines SL1, SL2, . . . , and SLn include first through n-th scan lines SL1 through SLn that are sequentially aligned. The data lines DL1, DL2, . . . , DLm intersect the scan lines SL1, SL2, . . . , SLn. For example, the data lines DL1, DL2, . . . , DLm may extend in a first direction d2, which crosses or is perpendicular to the second direction d1, and may be substantially parallel with one another. The second direction d1 may correspond to a row direction, and the first direction d2 may correspond to a column direction.

The pixels PX may be arranged in a matrix. Each of the pixels PX may be connected to one of the scan lines SL1, SL2, . . . , SLn and one of the data lines DL1, DL2, . . . , DLm. Each of the pixels PX receive one of a plurality of scan signals S1, S2, . . . , Sn from one of the scan lines SL1, SL2, . . . , SLn connected thereto, and receives a data voltage from one of the data lines DL1, DL2, . . . , DLm connected thereto in response to receipt of one of the scan signals S1, S2, . . . . Sn. Also, each of the pixels PX may receive a first power source voltage ELVDD via a first power line and a second power source voltage ELVSS via a second power line.

The control unit 140 may receive an image signal (R, G, B) and a control signal TCS for controlling the image signal (R, G, B). The control signal TCS may be a vertical synchronization signal Vsync, a horizontal synchronization signal Hsync, a main clock signal MCLK, or a data enable signal DE. The control unit 140 may process the control signal TCS to be suitable for the operating conditions of the display panel 110, and may generate image data DATA, a data control signal DCS, and a scan control signal SCS.

The data control signal DCS may include a horizontal synchronization start signal STH, which provides an instruction to start input of the image data DATA, and a load signal TP, which provides one or more instructions to apply a data voltage to each of the data lines DL1, DL2, . . . , DLm. The scan control signal SCS may include a scan initiation start signal STV, which provides one or more instructions to start the output of the scan signals S1, S2, . . . , Sn, and a gate clock signal CPV for controlling an output time of a scan-on pulse.

The scan driving unit 150 receives the scan control signal SCS from the control unit 140. The scan driving unit 150 outputs the scan signals S1, S2, . . . , Sn to the display panel 110 in response to receipt of the scan control signal SCS.

The data driving unit 120 may include, for example, a shift register, a latch, and/or a digital-to-analog converter (DAC). The data driving unit 120 receives the data control signal DCS and the image data DATA from the control unit 140. The data driving unit 120 chooses a reference voltage according to the data control signal DCS, and converts the image data DATA, which may have a digital waveform, into a plurality of data voltages based on the reference voltage. The data driving unit 120 outputs the data voltages to the display panel 110.

The display panel 110 includes at least one first pixel column PX1, at least one second pixel column PX2, and at least one third pixel column PX3. Each of the first and second pixel columns PX1 and PX2 includes at least one first pixel P1, which emits light of a first color (S1, S2, S3), and at least one second pixel P2, which emits light of a second color different from the first color. The third pixel column PX3 includes at least one third pixel P3, which emits light of a third color different from the first and second colors. The first color, the second color, and the third color may be, for example, red, blue, and green, respectively. Alternatively, the first color, the second color, and the third color may be blue, red, and green, respectively, or a different combination of colors.

In one embodiment, each of the first, second, and third pixel columns PX1, PX2 and PX3 include one or more additional pixels that emit light of colors different from the first, second, and third colors. The additional color may be white, for example.

In the first pixel column PX1, the first pixel P1 and the second pixel P2 may be alternately arranged along the first direction d2. In the second pixel column PX2, the first pixel P1 and the second pixel P2 may be alternately arranged along the first direction d2 in a similar manner to, but in a reverse order from, the first pixel column PX1. For example, the first pixel P1 of the first pixel column PX1 and the second pixel P2 of the second pixel column PX2 may be arranged in a row along the second direction d1. The second pixel P2 of the first pixel column PX1 and the first pixel P1 of the second pixel column PX2 may be arranged in a row along the second direction d1.

In the third pixel column PX3, the third pixel P3 may be arranged along the first direction d2. The first and second pixel columns PX1 and PX2 may be alternately arranged along the second direction d1. The third pixel column PX3 may be between the first and second pixel columns PX1 and PX2. For example, the display panel 110 may have a Pen Tile structure, in which the first pixel column PX1 and the third pixel column PX3 are arranged next to each other and the second pixel column PX2 and another third pixel column PX3 are arranged next to each other, e.g., a Pen Tile structure in which red, green, and blue pixels are alternately arranged along the second direction d1.

Accordingly, a pair of adjacent first and third pixels P1 and P3 in the second direction d1, or a pair of adjacent second and third pixels P2 and P3 in the second direction d1, may form a unit pixel for displaying light of an image. Thus, the display panel 110 may provide a high-resolution screen without having to increase the number of pixels, as compared to other types of display panels in which red, green, and blue pixels form a unit pixel.

The first pixel column PX1 may be closer to the scan driving unit 150 than the second and third pixel columns PX2 and PX3, as illustrated in FIG. 1. In another embodiment, the third pixel column PX3 may be closer to the scan driving unit 150 than the first and second pixel columns PX1 and PX2. In this case, the first, second, and third pixel columns PX1, PX2, and PX3 may be arranged along the second direction d1 in the order of, for example, PX3, PX1, PX3, and PX2. The display panel 110 may have a Pen Tile structure, in which a plurality of pixels are arranged along the second direction d1 in the order of green, red, green, and blue pixels.

The first pixel P1 and the second pixel P2 of each of the first and second pixel columns PX1 and PX2 and the third pixel P3 of the third pixel column PX3 may be in a predetermined shape, e.g., rectangular. In other embodiments, the first pixel P1 and the second pixel P2 of each of the first and second pixel columns PX1 and PX2 and the third pixel P3 of the third pixel column PX3 may be in shapes other than a rectangular shape. Also, the first pixel P1 and the second pixel P2 of each of the first and second pixel columns PX1 and PX2 and the third pixel P3 of the third pixel column PX3 may have sizes different from those in FIG. 1.

The first pixel P1 of the first pixel column PX1 and the second pixel P2 of the second pixel column PX2 may be connected to the same scan line. The second pixel P2 of the first pixel column PX1 and the second pixel P2 of the second pixel column PX2 may be connected to the same data line, e.g., the first data line DL2. Accordingly, a second pixel data voltage DS2 may be applied to both the second pixel P2 of the first pixel column PX1 and the second pixel P2 of the second pixel column PX2 via the first data line DL2.

The first data line DL2 may be connected to the third pixel column PX3, which is arranged next to the first pixel column PX1 in the second direction d1. For example, the third column PX3 may be provided with a third pixel data voltage DS3 via the first data line DL2. The third pixel P3 of the third pixel column PX3 may be connected to different scan lines.

The first pixel P1 of the second pixel column PX2 and the first pixel P1 of another first pixel column PX1, that is arranged next to the second pixel column PX2 in the second direction d1, may be connected to the same data line, e.g., a second data line DL3. Accordingly, a first pixel data voltage DS1 may be applied, via the second data line DL3, to both the first pixel P1 of the second pixel column PX2 and the first pixel P1 of the other first pixel column PX1.

The first pixel P1 of the first pixel column PX1, which is closer than the second and third pixel columns PX2 and PX3 to the scan driving unit 150, may be connected to a data line DL1. The second data line DL3 may be connected to another third pixel column PX3 arranged next to the second pixel column PX2 in the second direction d1. For example, the other third pixel column PX3 may be provided with the third pixel data voltage DS3 via the second data line DL3. The second pixel P2 of the second pixel column PX2 and the third pixel P3 of the other third pixel column PX3 may be connected to different scan lines.

For example, the first data line DL2 may apply the second pixel data voltage DS2 to the second pixel P2 of each of the first and second pixel columns PX1 and PX2 and the third pixel data voltage DS3 to the third pixel P3 of the third pixel column PX3. The second data line DL3 may apply the first pixel data voltage DS1 to the first pixel P1 of each of the first and second pixel columns PX1 and PX2 and the third pixel data voltage DS3 to the third pixel P3 of the third pixel column PX3. Because a plurality of pixel columns share a single data line, instead of the cause where a plurality of data lines are provided for a respectively plurality of pixel columns, the number of circuits in the data driving unit 120 may be reduced. As a result, the manufacturing cost of the organic light-emitting display device 10 may be lowered.

The data voltage output unit 130 may selectively output the second pixel data voltage DS2 or the third pixel data voltage DS3 to the first data line DL2, and may selectively output the first pixel data voltage DS1 or the third pixel data voltage DS3 to the second data line DL3. The data voltage output unit 130 may be in the data driving unit 120. For example, the data voltage output unit 130 may be mounted in the data driving circuitry of the data driving unit 120, but this is not necessary.

Alternatively, the data voltage output unit 130 may be mounted on the display panel 110. For example, the data voltage output unit 130 may be formed on the display panel 110. Accordingly, the circuitry of the data driving unit 120 may be simplified and a narrow bezel structure may be realized.

Figure 2:
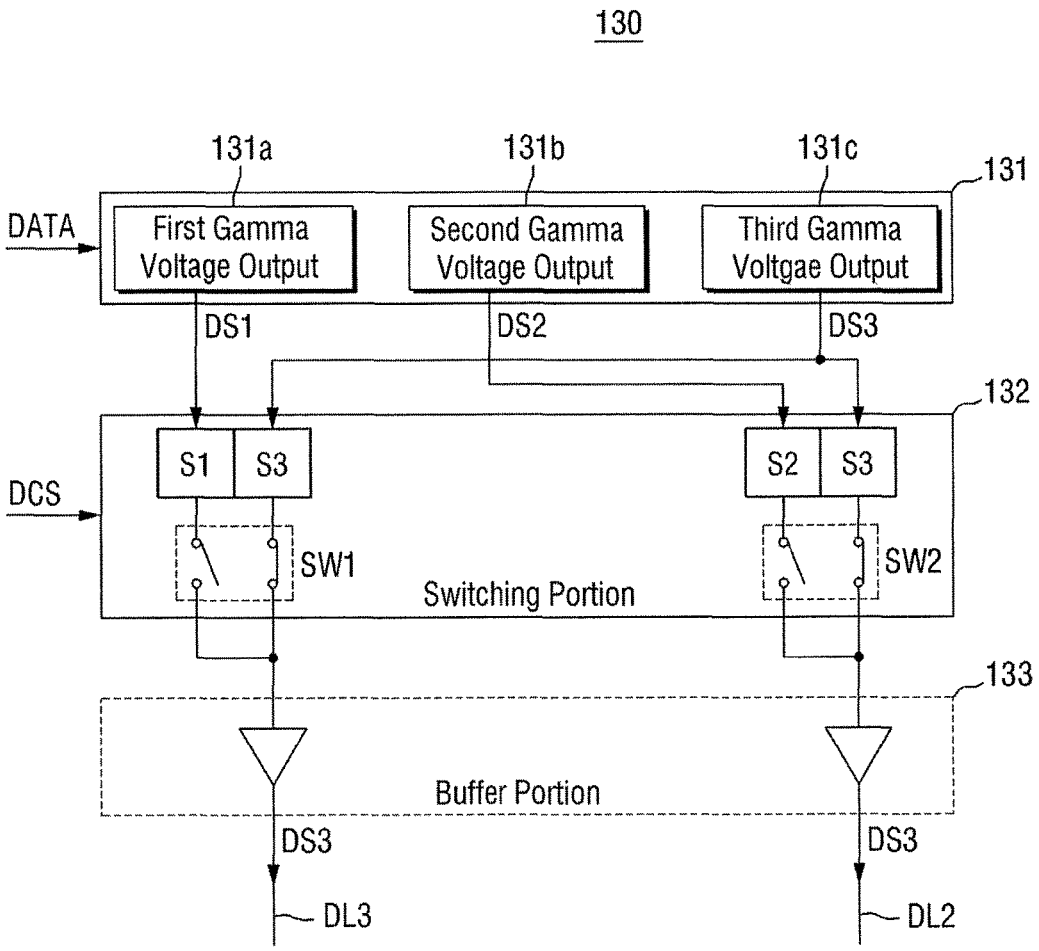
FIG. 2 illustrates an embodiment of a data voltage output unit.

FIG. 2 illustrates an embodiment of a data voltage output unit, which, for example, may correspond to the data voltage output unit 130 in FIG. 1. Referring to FIG. 2, the data voltage output unit 130 includes a data voltage generation portion 131, a switching portion 132, and a buffer portion 133.

The data voltage generation portion 131 receives image data DATA from the control unit 140. The image data DATA may include information relating to an image displayed by each of the pixels PX of the display panel 110. The data voltage generation portion 131 generates one or more gamma voltages corresponding to the image data DATA, and outputs the gamma voltage(s) to each of the pixels PX of the display panel 110.

The data voltage generation portion 131 includes a first gamma voltage output part 131*a*, a second gamma voltage output part 131*b*, and a third gamma voltage output part 131*c*. The first gamma voltage output part 131*a* generates a first gamma voltage to be provided to the first pixel P1 of each of the first and second pixel columns PX1 and PX2. The second gamma voltage output part 131*b* generates a second gamma voltage to be provided to the second pixel P2 of each of the first and second pixel columns PX1 and PX2. The third gamma voltage output part 131*c* generates a third gamma voltage to be provided to the third pixel P3 of the third pixel column PX3. The first gamma voltage may be the first pixel data voltage DS1, which is to be provided to the first pixel P1 of each of the first and second pixel columns PX1 and PX2. The second gamma voltage may be the second pixel data voltage DS2, which is to be provided to the second pixel P2 of each of the first and second pixel columns PX1 and PX2. The third gamma voltage may be the third pixel data voltage DS3, which is to be provided to the third pixel P3 of the third pixel column PX3. The gamma voltage output parts 131*a*, 131*b*, and 131*c* may be implemented as circuits, software, or a combination of both.

The first pixel P1 of each of the first and second pixel columns PX1 and PX2, the second pixel P2 of each of the first and second pixel columns PX1 and PX2, and the third pixel P3 of the third pixel column PX3 emit beams of different colors of light, and thus may be provided with different gamma voltages.

The first, second, and third gamma voltage output parts 131*a*, 131*b*, and 131*c* may provide a structure in which a reference voltage is divided into a plurality of strings. The first gamma voltage output part 131*a* may generate the first pixel data voltage DS1 based on the image data DATA. A number of first pixels P1 connected to different data lines may have different luminance levels. Thus, the level of the first pixel data voltage DS1 may vary from one data line to another data line. The second and third gamma voltage output parts 131*b* and 131*c* may generate the second pixel data voltage DS2 and the third pixel data voltage DS3, respectively, based on the image data DATA. The level of the second pixel data voltage DS2 may vary from one data line to another data line. The level of the third pixel data voltage DS3 may also vary from one data line to another data line. The first, second and third gamma voltage output parts 131*a*, 131*b*, and 131*c* may provide the first, second, and third pixel data voltages DS1, DS2, and DS3, respectively, to the switching portion 132.

The switching portion 132 receives the data control signal DCS from the control unit 140 and receives the first, second and third pixel data voltages DS1, DS2, and DS3 from the first, second, and third gamma voltage generation parts 131*a*, 131*b*, and 131*c*, respectively. The switching portion 132 may include a first switch unit SW1 and a second switch unit SW2. The first switch unit SW1 may include a switch to disconnect the first pixel data voltage DS1 and a switch to disconnect the third pixel data voltage DS3. The second switch unit SW2 may include a switch to disconnect the second pixel data voltage DS2 and a switch to disconnect the third pixel data voltage DS3.

The first pixel data voltage DS1 and the third pixel data voltage DS3 may be controlled by the first switch part SW1. The second pixel data voltage DS2 and the third pixel data voltage DS3 may be controlled by the second switch part SW2. For example, the first switch unit SW1 may selectively provide the first pixel data voltage DS1 or the third pixel data voltage DS3 to the second data line DL3, The second switch unit SW2 may selectively provide the second pixel data voltage DS2 or the third pixel data voltage DS3 to the first data line DL2. The first, second, and third pixel data voltages DS1, DS2, and DS3 may be applied to each data line via the buffer portion 133. The buffer portion 133 may amplify each of the first, second, and third pixel data voltages DS1, DS2, and DS3.

The first switch unit SW1 and the second switch unit SW2 may be turned on or off by the load signal TP, which is included in the data control signal DCS. Operation of the switching portion 132 will hereinafter be described, taking as an example, a plurality of pixels connected to the first data line DL2, to which the second switch unit SW2 is connected.

In response to a third pixel P3 of a third pixel column PX3 being turned on by the first scan signal S1, the load signal TP controls the second switch unit SW2 to be connected to the third pixel data voltage DS3.

Thereafter, in response to a second pixel P2 of a second pixel column PX2 being turned on by the second scan signal S2, which is followed by the first scan signal S1, the load signal TP controls the second switch unit SW2 to be connected to the second pixel data voltage DS2.

Thereafter, in response to another third pixel P3 of the third pixel column PX3 being turned on by the third scan signal S3, the load signal TP controls the second switch unit SW2 to be connected to the third pixel data voltage DS3.

Operation of the switching portion 132 will hereinafter be further described, taking as an example, a plurality of pixels connected to the second data line DL3 to which the first switch unit SW1 is connected.

In response to a third pixel P3 of a third pixel column PX3 being turned on by the first scan signal S1, the load signal TP controls the first switch unit SW1 to be connected to the third pixel data voltage DS3.

Thereafter, in response to a first pixel P1 of a first pixel column PX1 being turned on by the second scan signal S2, which is followed by the first scan signal S1, the load signal TP controls the first switch unit SW1 to be connected to the first pixel data voltage DS1.

Thereafter, in response to another third pixel P3 of the third pixel column PX3 being turned on by the third scan signal S3, the load signal TP controls the first switch unit SW2 to be connected to the third pixel data voltage DS3.

As mentioned above, each of the first and second switch units SW1 and SW2 of the switching portion 132 may have a simple structure for switching on or off a voltage to be applied to two pixels. Also, the frequency of the load signal TP, which is used to control each of the first and second switch unit SW1 and SW2, may be set low predetermined frequency. Accordingly, the circuit structure of the switching portion 132 may be simplified, and the switching portion 132 may be mounted in the data driving unit 120 to thereby occupy less space. Also, because the driving frequency of the switching portion 132 is set to be a low value, power consumption of the organic light-emitting display device 10 may be lowered.

Figure 3:
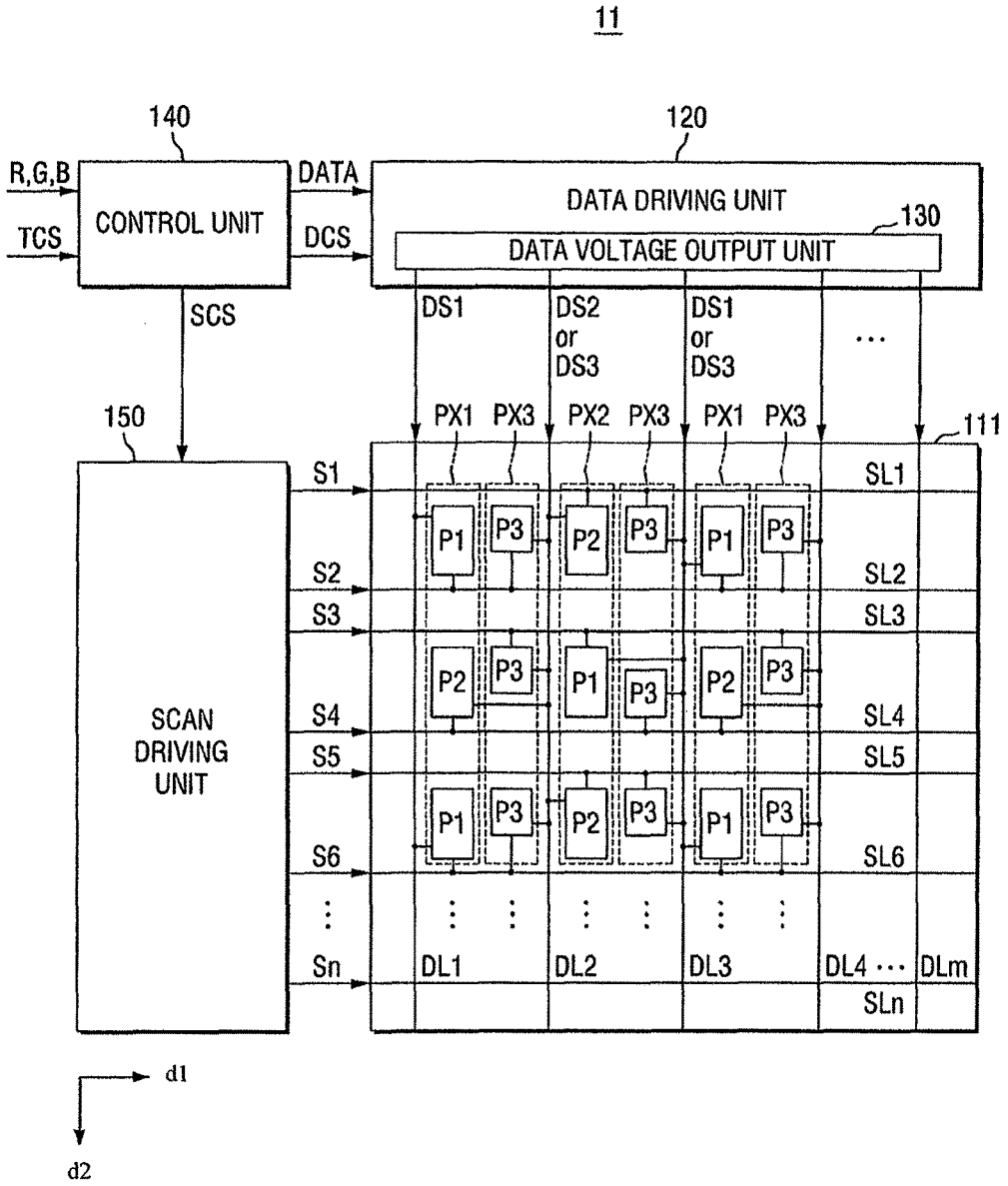
FIG. 3 illustrates another embodiment of an organic light-emitting display device.

FIG. 3 illustrates another embodiment of an organic light-emitting display device 11 includes a display panel 111 having a plurality of pixels arranged in a matrix.

The display panel 111 include at least one first pixel column PX1, at least one second pixel column PX2, and at least one third pixel column PX3. Each of the first and second pixel columns PX1 and PX2 includes at least one pixel P1 to emit light of a first color, and at least one second pixel P2 to emit light of a second color different from the first color. The third pixel column PX3 includes at least one third pixel P3 to emit light of a third color different from the first and second colors.

In the first pixel column PX1, the first pixel P1 and the second pixel P2 may be alternately arranged along a first direction d2. In the second pixel column PX2, the first pixel P1 and the second pixel P2 may be alternately arranged along the first direction d2 in a similar manner to, but in a reverse order from, the first pixel column PX1. For example, the first pixel P1 of the first pixel column PX1 and the second pixel P2 of the second pixel column PX2 may be arranged in a row along a second direction d1, and the second pixel P2 of the first pixel column PX1 and the first pixel P1 of the second pixel column PX2 may be arranged in a row along the second direction d1.

In the third pixel column PX3, the third pixel P3 may be arranged along the first direction d2. The first and second pixel columns PX1 and PX2 may be alternately arranged along the second direction d1. The third pixel column PX3 may be between the first and second pixel columns PX1 and PX2. For example, the display panel 110 may have a Pen Tile structure, in which the first pixel column PX1 and the third pixel column PX3 are arranged next to each other and the second pixel column PX2 and another third pixel column PX3 are arranged next to each other.

The first pixel P1 of the first pixel column PX1 and the second pixel P2 of the second pixel column PX2 may be connected to different scan lines. The second pixel P2 of the first pixel column PX1 and the second pixel P2 of the second pixel column PX2 may be connected to the same data line, e.g., the first data line DL2. Accordingly, a second pixel data voltage DS2 may be applied to both the second pixel P2 of the first pixel column PX1 and the second pixel P2 of the second pixel column PX2 via the first data line DL2. The first data line DL2 may be connected to the third pixel column PX3, which is arranged next to the first pixel column PX1 in the second direction d1. For example, the third column PX3 may be provided with a third pixel data voltage DS3 via the first data line DL2.

The first pixel P1 of the second pixel column PX2 and the first pixel P1 of another first pixel column PX1, that is arranged next to the second pixel column PX2 in the second direction d1, may be connected to the same data line, i.e., a second data line DL3. Accordingly, a first pixel data voltage DS1 may be applied, via the second data line DL3, to both the first pixel P1 of the second pixel column PX2 and the first pixel P1 of the other first pixel column PX1. The first pixel P1 of the first pixel column PX1, which is disposed closer than the second and third pixel columns P2 and P3 to the scan driving unit 150, may be connected to a data line DL1.

The second data line DL3 may be connected to another third pixel column PX3 that is arranged next to the second pixel column PX2 in the second direction d1. For example, the other third pixel column PX3 may be provided with the third pixel data voltage DS3 via the second data line DL3. The second pixel P2 of the second pixel column PX2 and the third pixel P3 of the other third pixel column PX3 may be connected to the same scan line.

Because a plurality of pixel columns share a single data line together, instead of having a plurality of data lines for a respective plurality of pixel columns, the number of circuits in the data driving unit 120 may be reduced. Other elements of the organic light-emitting display device 11 may be substantially the same as their respective counterparts in the organic light-emitting display device 10 of FIG. 1 or 2.

Figure 4:
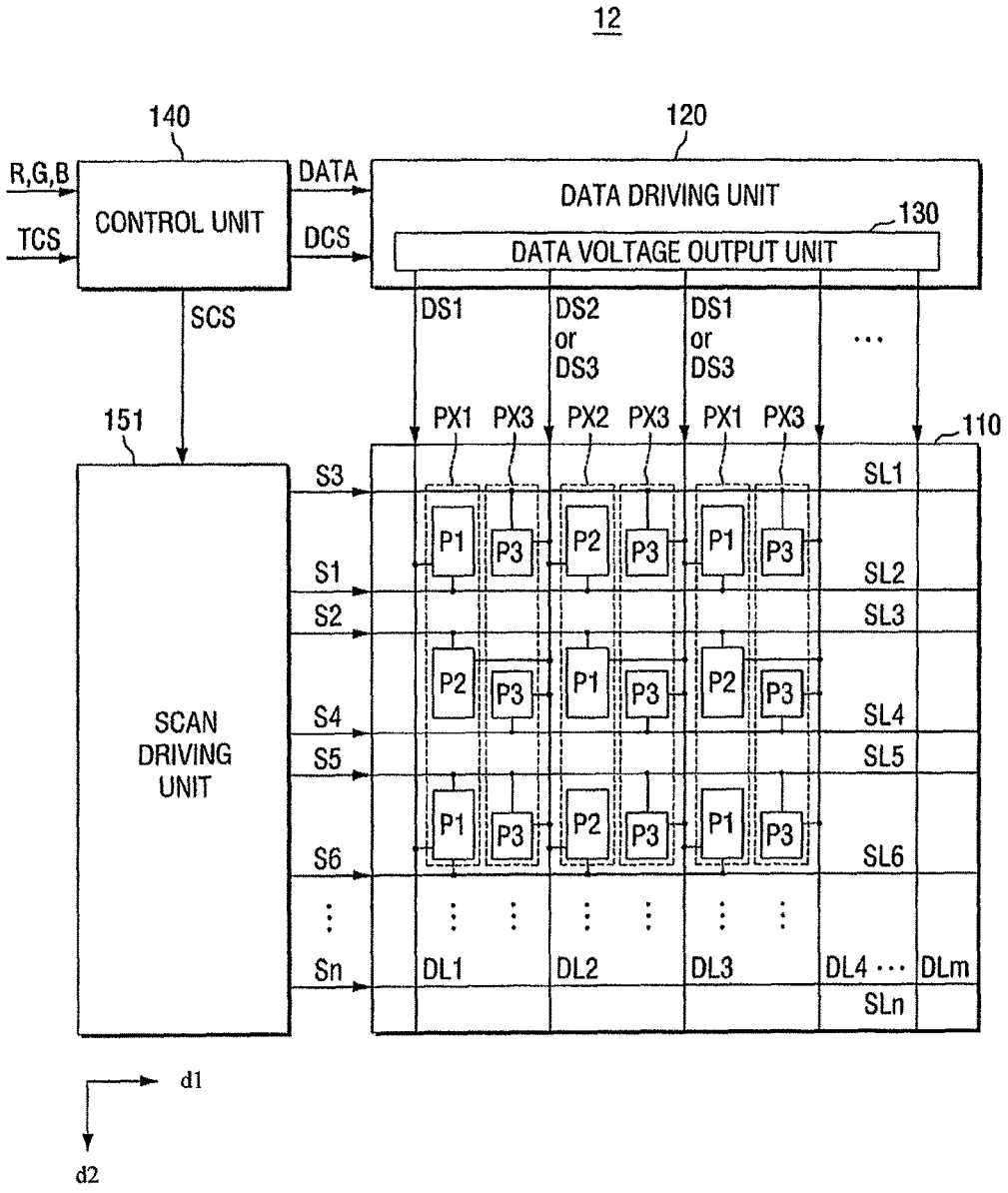
FIG. 4 illustrates another embodiment of an organic light-emitting display device.

FIG. 4 illustrates another embodiment of an organic light-emitting display device 12 which includes a scan driving unit 151.

The scan driving unit 151 provides a plurality of scan signals S1, S2, . . . , Sn to a plurality of scan lines SL1, SL2, . . . , SLn, respectively, which are formed on a display panel 110. The scan driving unit 151 may apply the scan signals S1, S2, . . . , Sn in such a manner that a second pixel P2 of a second pixel column PX2 and then a second pixel P2 of a first pixel column PX1 may be turned on.

For example, the second pixel P2 of the second pixel column PX2 may be turned on by the first scan signal S1, and may thus be provided with a second pixel data voltage DS2 via a first data line DL2.

Thereafter, the second pixel P2 of the first pixel column PX1 may be turned on by the second scan signal S2, which is followed by the first scan signal S1, and thus may be provided with the second pixel data voltage DS2 via the first data line DL2.

Thereafter, a third pixel P3 of a third pixel column PX3 between the first and the second pixel columns PX1 and PX2 may be turned on by the third scan signal S3, which is followed by the second scan signal S2, and thus may be provided with a third pixel data voltage DS3 via the first data line DL2.

Thereafter, another third pixel P3 next in line to the turned-on third pixel P3 may be turned on by the fourth scan signal S4, which is followed by the third scan signal S3, and thus may be provided with the third pixel data voltage DS3.

Thus, the second data line DL2 may apply a pixel data voltage in the order of, for example, DS2, DS2, DS3, and DS3. Accordingly, the number of switching operations for switching from one pixel data voltage to another pixel data voltage may be reduced, or minimized, by varying the scanning order. As a result, the frequency of a load signal TP for controlling a switching unit 131 may be lowered, and power consumption of the organic light-emitting display device 12 may be reduced. Other elements of the organic light-emitting display device 12 may be substantially the same as the organic light-emitting display device 10 of FIG. 1 or 2.

Figure 5:
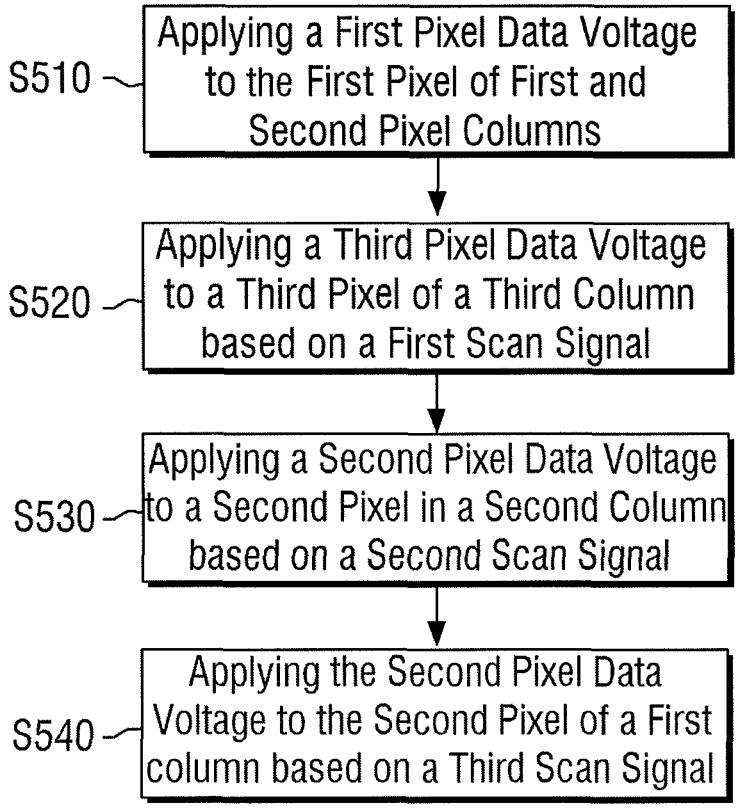
FIG. 5 illustrates an embodiment of a method for driving an organic light-emitting display device.

FIG. 5 illustrates an embodiment of a method for driving an organic light-emitting display device. The method includes applying a data voltage to a display device. The display device may be any of those previously mentioned. For illustrative purposes only, it will be assumed that the display device an organic light-emitting display device. The organic light-emitting display device may be, for example, the organic light-emitting display device 10 in FIG. 1 or 2.

In the organic light-emitting display device, a second pixel P2 of a first pixel column PX1, a second pixel P2 of a second pixel column PX2, and a third pixel P3 of a third pixel column PX3 may be connected to the same data line. A third pixel data voltage DS1 or a second pixel data voltage DS2 may be applied via the data line.

The operation of applying a data voltage includes applying a first pixel data voltage to the first pixel P1 of each of the first and second pixel columns PX1 and PX2 (S510). A third pixel data voltage DS3 is applied to the third pixel P3 of the third pixel column PX3 based on a first scan signal S1 (S520). The second pixel data voltage DS2 is applied to the second pixel in the second pixel column PX2 based on a second scan signal S2 (S530), which is followed by the first scan signal S1. The second pixel data voltage DS2 is applied to the second pixel P2 of the first pixel column PX1 based on a third scan signal S3, which is followed by the second scan signal S2 (S540). That is, the second pixel data voltage DS2 or the third pixel data voltage DS3 may be provided to a turned-on second pixel P2 or third pixel P3.

In the driving method, two pixel data voltages for two pixels connected to a single data line may be selectively applied. Because a plurality of pixel columns share a single data line together, instead of having a plurality of data lines for a respective plurality of pixel columns, the number of circuits in a data driving unit may be reduced. As a result, the manufacturing cost of the organic light-emitting display device may be lowered.

Figure 6:
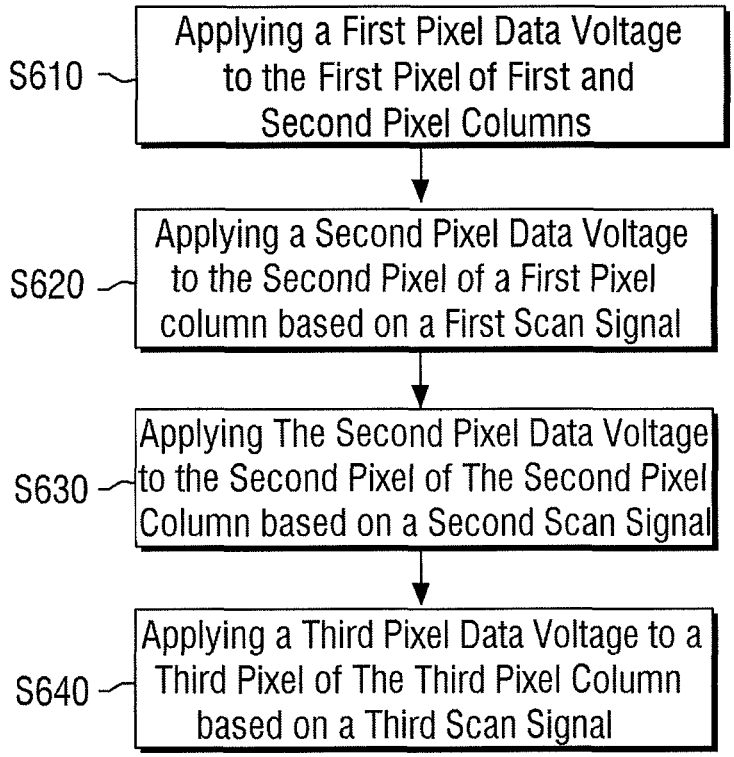
FIG. 6 illustrates another embodiment of a method for driving an organic light-emitting display device.

FIG. 6 illustrates another embodiment of a method for driving an organic light-emitting display device. The method includes applying a data voltage to a display device. The display device may be any of those previously mentioned.

The operation of applying a data voltage includes applying a first pixel data voltage to the first pixel P1 of each of the first and second pixel columns PX1 and PX2 (S610). The second pixel data voltage DS2 is applied to the second pixel P2 of the first pixel column PX1 based on the first scan signal S1 (S620). The second pixel data voltage DS2 may be applied to the second pixel P2 of the second pixel column PX2 based on the second scan signal S2, which is followed by the first scan signal S1 (S630). The third pixel data voltage DS3 may be applied to the third pixel P3 of the third pixel column PX3, which is arranged next to the first pixel column PX2 in a second direction d1, based on the third scan signal S3, which is followed by the second scan signal S2 (S640).

Accordingly, each pixel may be turned on by a scan signal to reduce, or minimize, the number of switching operations for switching from one pixel data voltage to another pixel data voltage. Also, a pixel data voltage may be applied to each turned-on pixel. Therefore, the frequency of a load signal TP for controlling a switching unit may be lowered. As a result, power consumption of the organic light-emitting display device may be reduced.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light-emitting display device, comprising:

a display panel having a plurality of pixels arranged in a matrix, the plurality of pixels including:

a first pixel column including first pixels to emit light of a first color and second pixels to emit light of a second color alternately arranged in a first direction, a second pixel column including the first pixels and the second pixels arranged in the first direction in a reverse order from the first pixel column, and at least one third pixel column including third pixels to emit light of a third color and arranged in the first direction, wherein the first pixel column and the second pixel column are alternately arranged along a second direction crossing the first direction, wherein the third pixel column is between the first pixel column and the second pixel column, wherein the second pixel of the first pixel column and the second pixel of the second pixel column are connected to a same data line, and wherein:

one of the first pixels of the first pixel column, one of the first pixels of the second pixel column, and one of the third pixels of the third pixel column, which is arranged next to the first pixel column in the second direction, are connected to a first data line, and the second pixel of the first pixel column, the second pixel of the second pixel column, and a third pixel of another third pixel column, which is arranged next to the second pixel column in the second direction, are connected to a second data line.

2. The device as claimed in claim 1, further comprising:
a data voltage output to apply a first pixel data voltage or a third pixel data voltage to the first data line and to apply a second pixel data voltage or the third pixel data voltage to the second data line.

3. The device as claimed in claim 2, wherein the data voltage output includes a gamma voltage output to generate the first, second, and third pixel data voltages, a switching circuit to selectively output the first, second, and third pixel data voltages, and a buffer to amplify the first, second, and third pixel data voltages.

4. The device as claimed in claim 2, wherein the data voltage output is in the display panel.

5. The device as claimed in claim 1, wherein:
the display panel includes a plurality of scan lines extending in the second direction,
the first pixel of the first pixel column and the third pixel of the third pixel column, which is arranged next to the first pixel column in the second direction, are connected to different scan lines, and
the second pixel of the second pixel column and the third pixel of the other third pixel column, which is arranged next to the second pixel column in the second direction, are connected to different scan lines.

6. The device as claimed in claim 1, wherein:
the display panel includes a plurality of scan lines extending in the second direction,
the first pixel of the first pixel column and the third pixel of the third pixel column, which is arranged next to the first pixel column in the second direction, are connected to the same scan line, and
the second pixel of the second pixel column and the third pixel of the other third pixel column, which is arranged next to the second pixel column in the second direction, are connected to the same scan line.

7. The device as claimed in claim 1, wherein:
the display panel includes a plurality of scan lines extending in the second direction, and
a plurality of scan signals are applied to the plurality of scan lines, respectively, in such a manner that the second pixel of the second pixel column and then the second pixel of the first pixel column are turned on.

8. The device as claimed in claim 7, wherein the plurality of scan signals are applied to the plurality of scan lines, respectively, in such a manner that the second pixel of the first pixel column and then the third pixel of the third pixel column, which is arranged next to the first pixel column in the second direction, are turned on.

9. The device as claimed in claim 1, wherein the first, second, and third colors are red, blue and green, respectively.

10. An organic light-emitting display device, comprising:
a plurality of data lines extending in a first direction;
a plurality of scan lines extending in the second direction crossing a first direction; and
a plurality of pixels including:
a first pixel column including first pixels to emit light of a first color and second pixels to emit light of a second color alternately arranged in the first direction,
a second pixel column including the first pixels and the second pixels arranged in the first direction in a reverse order from the first pixel column, and
at least one third pixel column including third pixels to emit light of a third color and arranged in the first direction, wherein the plurality of pixels forms a Pen Tile structure in which the first pixel column and the third pixel column are arranged next to each other, and the second pixel column and another third pixel column are arranged next to each other, wherein the second pixel of the first pixel column and the second pixel of the second pixel column are connected to a same data line, and wherein:
the first pixel of the first pixel column, the first pixel of the second pixel column, and a third pixel of the third pixel column, which is arranged next to the first pixel column in the second direction, are connected to a first data line, and
the second pixel of the first pixel column, the second pixel of the second pixel column, and a third pixel of another third pixel column, which is arranged next to the second pixel column in the second direction, are connected to a second data line.

11. The device as claimed in claim 10, further comprising:
a data voltage output to apply a first pixel data voltage or a third pixel data voltage to the first data line and to apply a second pixel data voltage or the third pixel data voltage to the second data line.

12. The device as claimed in claim 11, wherein the data voltage output includes a gamma voltage output to generate the first, second, and third pixel data voltages, a switching circuit to selectively output the first, second, and third pixel data voltages, and a buffer to amplify the first, second, and third pixel data voltages.

13. The device as claimed in claim 10, wherein the first pixel column, the third pixel column, the second pixel column, and another third pixel column are sequentially arranged side-by-side in the second direction.

14. The device as claimed in claim 10, wherein the third pixel column, the first pixel column, another third pixel column, and the second pixel column are sequentially arranged side-by-side in the second direction.

15. A method for driving an organic light-emitting display device, the method comprising:
providing an organic light-emitting display device which includes a display panel having a plurality of pixels arranged in a matrix, the plurality of pixels including:
(a) a first pixel column including first pixels to emit light of a first color and second pixels to emit light of second color alternately arranged in a first direction,
(b) a second pixel column including the first pixels and the second pixels arranged in the first direction in a reverse order from the first pixel column, and
(c) at least one third pixel column including third pixels to emit light of a third color and arranged in the first direction, the first pixel column and the second pixel column alternately arranged along a second direction crossing the first direction, the third pixel column between the first pixel column and the second pixel column, and the second pixel of the first pixel column and the second pixel of the second pixel column connected to a same data line;
applying a first pixel data voltage to the first pixel of each of the first and second pixel columns; and
applying a third pixel data voltage or a second pixel data voltage to the data line to which the second pixel of the first pixel column and the second pixel of the second pixel column are connected, wherein the applying includes:
applying the third pixel data voltage to a third pixel of the third pixel column based on a first scan signal,
applying the second pixel data voltage to the second pixel of the second pixel column based on a second scan signal, which is followed by the first scan signal, and applying the second pixel data voltage to the second pixel of the first pixel column based on a third scan signal, which is followed by the second scan signal.

16. The method as claimed in claim 15, wherein applying includes:

applying the second pixel data voltage to the second pixel of the first pixel column based on a first scan signal, applying the second pixel data voltage to the second pixel of the second pixel column based on a second scan signal, which is followed by the first scan signal, and applying the third pixel data voltage to a third pixel of the third pixel column, which is arranged next to the first pixel column in the second direction, based on a third scan signal, which is followed by the second scan signal.

17. The method as claimed in claim 15, wherein the first, second, and third colors are red, blue and green, respectively.

* * * * *